US006257472B1

(12) United States Patent
Freedman

(10) Patent No.: US 6,257,472 B1
(45) **Date of Patent: *Jul. 10, 2001**

(54) BACKPACK

(76) Inventor: Franceslynn Freedman, R.R. 2, Box 134 N. Clove Rd., Verbank, NY (US) 12585

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/252,557

(22) Filed: Feb. 19, 1999

(51) Int. Cl.[7] ..... A45F 3/02

(52) U.S. Cl. ..... 224/614; 150/108; 224/601; 224/606; 224/608; 224/627

(58) Field of Search ..... 224/656, 153, 224/FOR 219, 578, 627, 608, 614, 606, 601; D3/217, 216; 150/118, 3; 383/4, 6, 9, 74, 76, 26; 24/459

(56) References Cited

U.S. PATENT DOCUMENTS

| | | | | |
|---|---|---|---|---|
| 3,653,583 | * | 4/1972 | Meyer | 383/26 |
| 4,079,767 | * | 3/1978 | Howard | 150/3 |
| 4,194,602 | * | 3/1980 | Allen | 224/578 |
| 4,988,216 | * | 1/1991 | Lyman | 383/74 |
| 5,957,354 | * | 9/1999 | Mentken | 224/614 |

FOREIGN PATENT DOCUMENTS

| | | | | |
|---|---|---|---|---|
| 95653 | * | 1/1924 | (AT) | 224/209 |
| 288909 | * | 2/1953 | (CH) | 224/209 |
| 57828 | * | 9/1923 | (SE) | 383/76 |

* cited by examiner

*Primary Examiner*—Gregory M. Vidovich
*Assistant Examiner*—Maerena W. Brevard
(74) *Attorney, Agent, or Firm*—Watov & Kipnes, P.C.

(57) ABSTRACT

A backpack having a front and back panel and side panels foldable one upon the other in which a strap for securing about the shoulders includes a strap guide which is fixed to the side and front panels to maintain the strap in position to enable the side panels to be folded and unfolded.

9 Claims, 8 Drawing Sheets

BACKPACK

FIELD OF THE INVENTION

The present invention is directed to a backpack which is mounted about the back with straps that fit over the shoulders of the user. The backpack has a central section formed from foldable panels which are controlled by straps and secured by a strap guide assembly which enables the panels to fold one upon the other when the backpack is secured about the shoulders to provide greater safety and security of the contents contained in the backpack. The backpack provides flexibility yet can carry flat materials (e.g. paper) in an unfolded condition.

BACKGROUND OF THE INVENTION

Backpacks or knapsacks have been in use for many years. Such devices typically comprise a central storage compartment and optional secondary storage compartments. Attached to the central storage compartment is generally two straps which are worn about the shoulders of the user so that the backpack is partially supported by the shoulders and the back of the user.

Backpacks of the type disclosed in U.S. Pat. Nos. 432,607; 5,129,560; 5,431,317; and 5,577,652 are generally stiff shaped or non-flexible backpacks. Such backpacks typically have closures such as zippers. Such non-flexible backpacks are not comfortable because they have stiff edges which apply pressure to various portions of the user's back, and are awkward to carry. In addition, such backpacks can not be condensed so that they can be easily stored within a suitcase and transported during travel.

Another disadvantage of conventional backpacks whether having a zipper or drawstring closure is that entry to the central storage section is typically exposed to the public when the user is wearing the backpack. The closure is rather an easy target for someone who wishes to gain entry into the backpack even when the backpack is worn by the user.

It is therefore desirable in the backpack industry to provide a backpack assembly which is flexible, more comfortable to wear, allows for storage of materials in a flat condition and provides greater security than conventional backpacks described above. It would therefore be an advance in the art of developing backpacks to provide a backpack which provides a surface in contact with the back of the user which is generally flexible, conforms to the contour of the user's back, yet can carry flat materials in an unfolded condition. It would be a further advance in the backpack art to provide a backpack having a closure system which can not be readily tampered with when the user is wearing the backpack.

SUMMARY OF THE INVENTION

The present invention is generally directed to a backpack having a series of foldable panels which form the central storage section which panels can be folded one upon the other when the backpack is worn by the user. The backpack also provides for a strap assembly which facilitates the folding of the panels one upon the other and provides a secure closure of the central storage section when the backpack is operably carried by the user.

In one aspect of the present invention, the backpack comprises:

a) a central storage compartment comprising a bottom panel, a front panel, a back panel and plurality of opposed side panels foldable upon each other, said panels defining an upper opening for entry into the central storage compartment;

b) a strap secured to the backpack for releasably enabling the side panels to move from a folded condition thereby closing the upper opening to an unfolded condition whereby the upper opening allows access to the central storage compartment;

c) strap guide means operably fixed to the side and front panels to maintain the strap in position to enable the side panels to be folded and unfolded; and d) strap attachment means for securing the strap to the front panel at a position to enable the strap to be placed about the shoulders of the user.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 4:
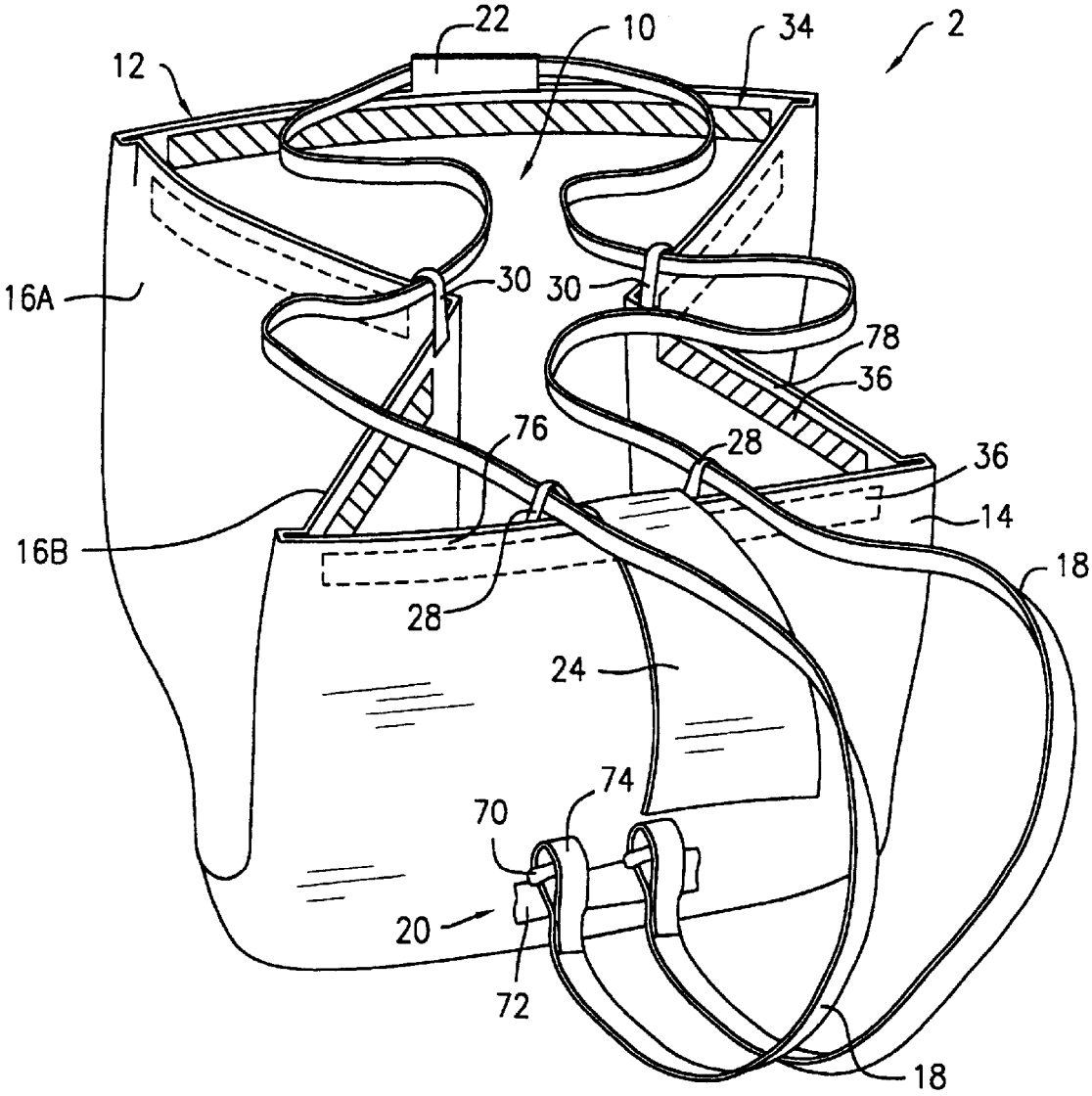
FIG. 4 is a perspective view of the embodiment shown in FIG. 1 with the backpack in position for receiving or removing articles from the central storage compartment.

The present invention is generally directed to a backpack in which access to the backpack is substantially prevented when the backpack is worn by the user. In a first embodiment of the present invention, as represented by FIGS. 1–4, there is shown a backpack 2 having a topside 4 with an opening 6 therein providing access to a central storage compartment 10 as best shown in FIG. 4. Opposite the topside 4 is a bottomside 8 which forms the base or floor of the central storage compartment 10.

The central storage compartment 10 is formed by the interconnection of a front panel 12, a back panel 14, and a plurality of opposed side panels 16 which, as explained hereinafter, fold upon each other in accordance with the present invention. In the embodiments specifically shown in FIGS. 1–4, the backpack 2 is provided with two side panels 16A and 16B.

It will be understood that the aforementioned panels 12, 14, and 16 are described herein for convenience as separate panels which are connected together by stitching or the like. It will be understood that the present invention also provides for the panels to be integral with each other (ie. formed from a single piece of material).

The backpack 2 includes a pair of strap arms 18 which are secured to both the front panel 12 and the back panel 14. As shown in FIGS. 1–4, there is a single strap piece having a pair of strap arms 18 each of which is adapted to fit over a respective shoulder of the user. In the embodiment illustrated in FIGS. 1–4, the attachment of the strap arms 18 to the front and back panels is best illustrated in FIG. 4. As shown in FIG. 4, the strap arms 18 are secured to the back panel 14 by a back strap securing device 20. The securing device 20 secures the strap arms to the backpack 2 at the back panel 14, but does not otherwise assist in the closing of the backpack 2 as hereinafter described. The securing device 20 includes a loop 70 secured to a substrate 72 which itself is secured to the back panel 14. The strap arms 18 are provided with loops 74 which interact with the loops 70 to provide attachment of the strap arms 18 to the back panel 14. The substrate 72 can be any support material which can be attached to the back panel 14 and to which can be attached a loop 70 to secure the strap arms 18. The support material can be made from plastic, fabric, leather, and the like. Most typically, the support material will be selected from the same type of material that is used to construct the backpack.

The strap arms 18 are secured to the front panel 12 through a front strap securing device 22 which may be in the form of an upstanding strap support as best shown in FIG. 4. It is desirable to provide an elongated strap support for the front strap securing devices 22 so as to enable the strap arms 18 to more easily extend along the opposed sides of the backpack as explained hereinafter. The front strap securing device 22, unlike the back strap securing device 20, does assist in the closing of the backpack 2 and the securing of the contents therein when the backpack 2 is operatively situated on the user's back.

In accordance with one aspect of the present invention, the strap arms 18 are provided with a strap guide means 26 that preforms at least two functions. The first function is to position the strap arms 18 along opposed sides of the backpack from the back strap securing device 20 to the front strap securing device 22. The strap guide means 26 also serves to enable the side panels 16 to fold upon themselves when the straps are secured about the shoulders of the user.

Figure 1:
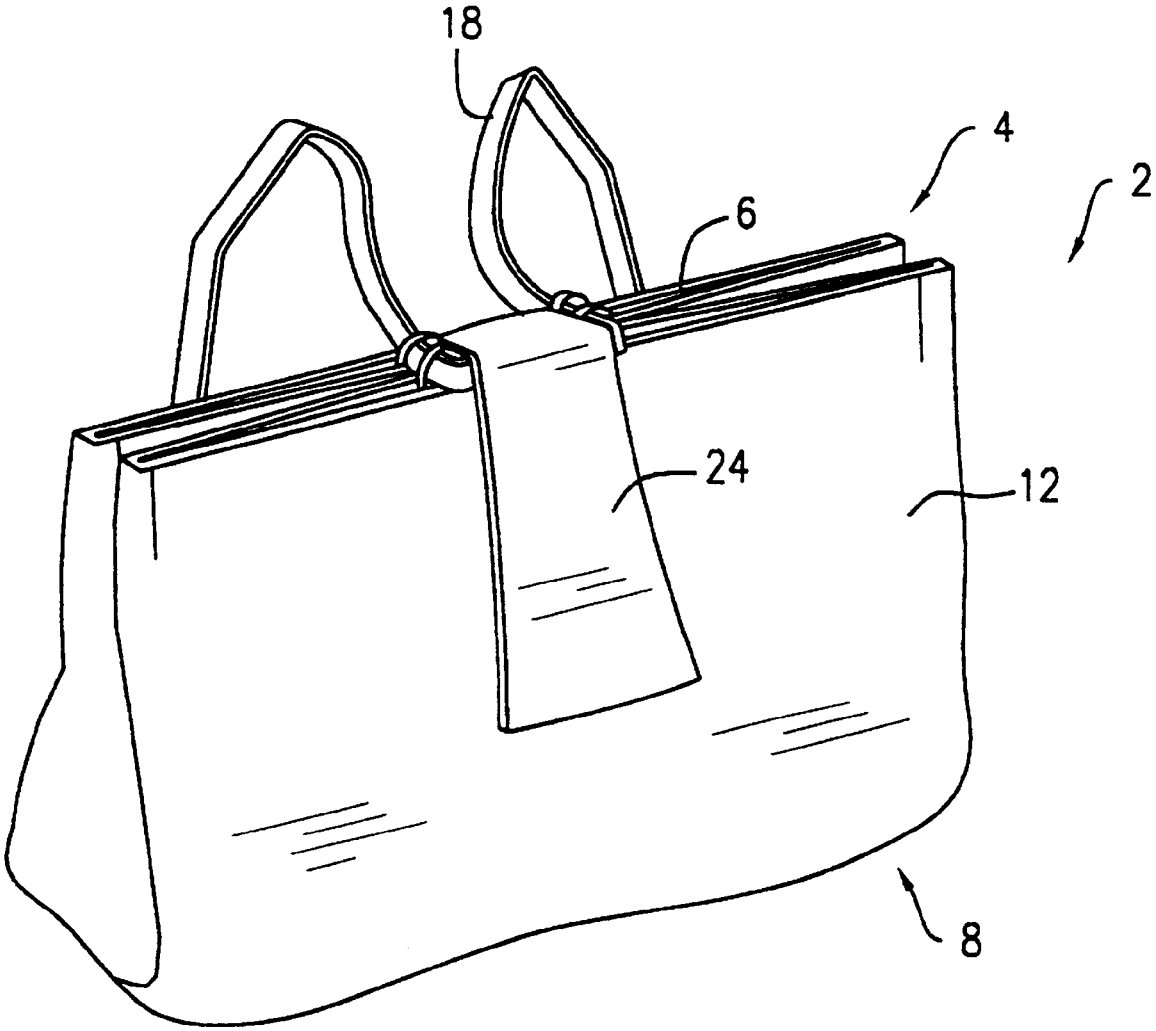
FIG. 1 is a perspective view of the front of one embodiment of the present invention shown in the closed position employing upstanding loops as a strap guide.
Figure 2:
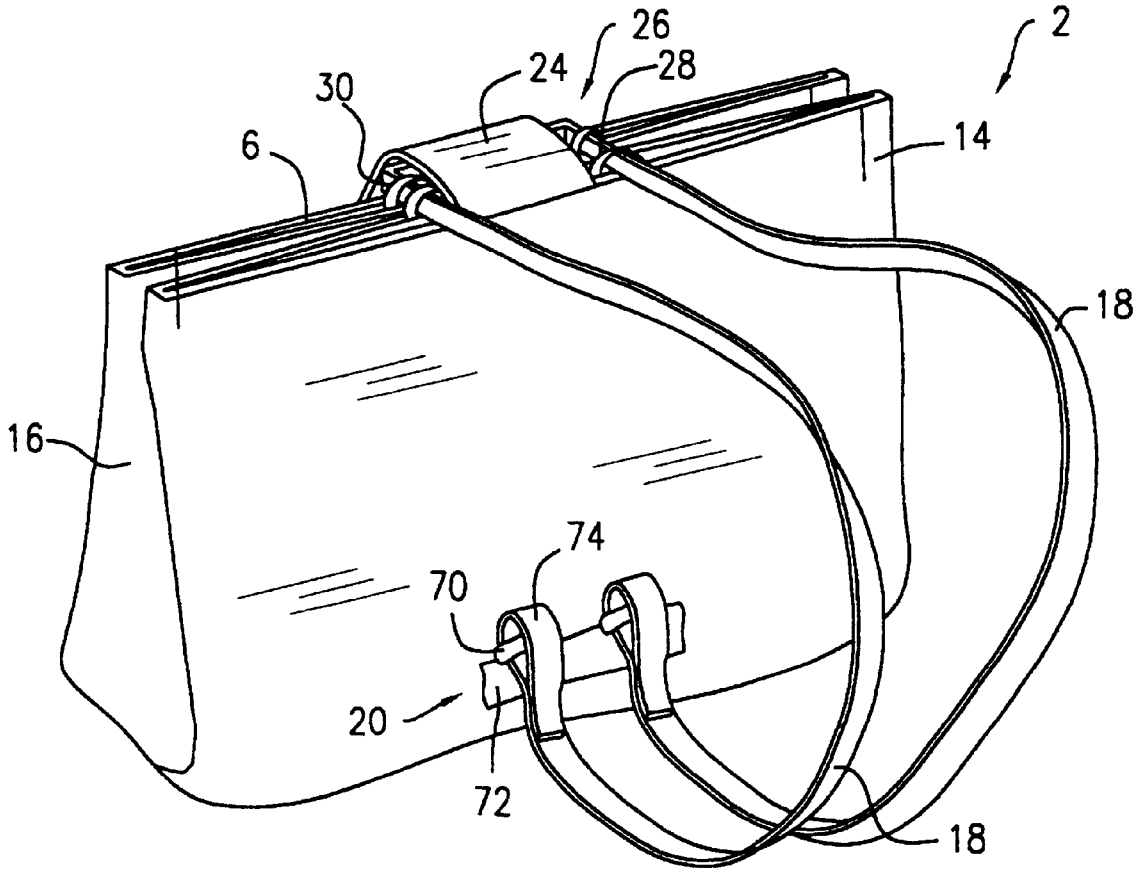
FIG. 2 is a rear view of the embodiment shown in FIG. 1.
Figure 3:
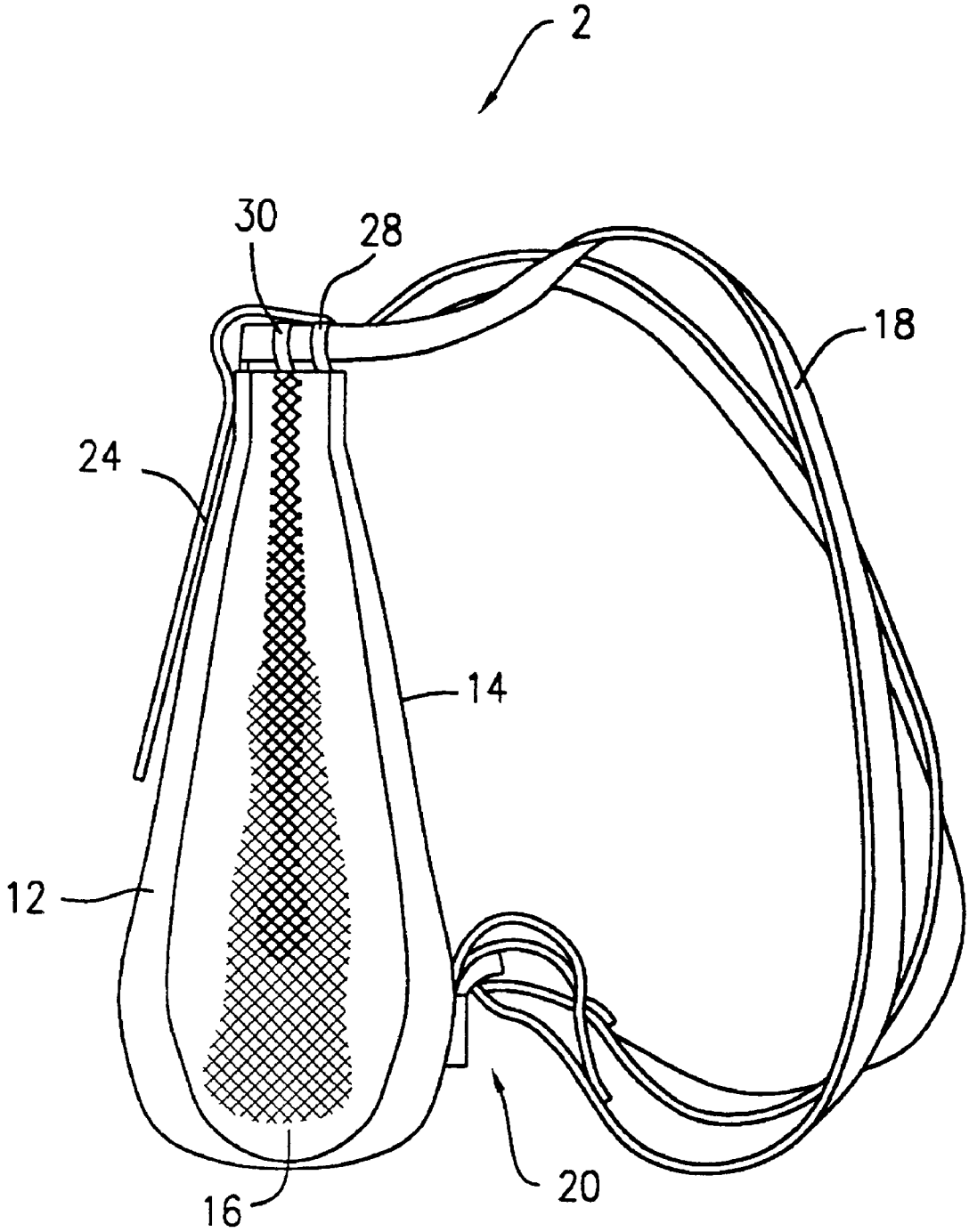
FIG. 3 is a side view of the embodiment shown in FIG. 1.

In the embodiment shown in FIGS. 1–4, the strap guide means 26 includes back panel upstanding loops 28 and side panel upstanding loops 30. The upstanding loops 28 and 30 are secured to the upper edge portion 76 of the back panel 14 and the upper edge portion 78 of the side panels 16. The loops 28 and 30 extend above the topside 4 of the backpack when the backpack is in the closed position as illustrated in FIG. 1 and in the open position as illustrated in FIG. 4.

In operation, the user places the backpack 2 in the open position as illustrated in FIG. 4 to gain access to the central storage compartment 10. Articles may be placed into the central storage compartment or removed therefrom when the backpack 2 is in the position shown in FIG. 4. When the user places the backpack in the carrying position by placing the strap arms 18 around the shoulders so that the back panel 14 rests against the users back, the straps automatically are pulled forward towards the user so that pressure is exerted on the front strap securing device 22 forcing the front panel 12 to move towards the back panel 14. This exerts a force on the junction between the respective side panels 16A and 16B so that they begin to fold one upon the other. At the same time, the side panel upstanding loops 30 are so positioned that the interaction of the strap arms 18 and the upstanding loops 30 creates a further pressure on the respective side panels 16 to fold one upon the other so that the backpack moves from the position shown in FIG. 4 to the position shown in FIG. 1. When the backpack is in the position shown in FIG. 1, it is difficult for a person to gain access to the opening 6 of the backpack because the interaction between the strap arms 18 and the strap guide means 26 maintains the backpack 2 in the closed position shown in FIG. 1 denying access to the central storage compartment 10. This provides the user with greater security against those who seek to obtain unlawful entry to the backpack while it is being worn by the user.

Further security can be provided to the backpack 2 through the employment of a flap 24. The flap is secured to the inside surface of the back panel 14. When the backpack 2 is in the closed position as shown in FIG. 1, the flap 24 passes over the opening 6 and is secured to the outside surface of the front panel 12. The flap 24 may be secured to the inside surface of the back panel 14 by stitching, adhesive or the like and is preferably secured to the outside surface of the front panel 12 through a releaseable attachment means (not shown) such as a hook and eye attachment assembly sold under the trademark Velcro. As best shown in FIG. 1, the flap 24 when secured about the backpack 2 provides an additional measure of security against unlawful entry into the opening 6 leading to the central storage compartment 10.

In a further optional and preferred embodiment of the invention as best illustrated in FIG. 4, the inside surfaces of the front panel 12, back panel 14 and side panels 16 can be provided with a releasable attachment means 34 preferably comprised of hook and eye strips 36 sold under the trademark Velcro.

It will be understood that the outside surface of the respective panels may be provided with the releasable attachment means 34. It is preferred, however, to provide the inside surfaces with the releasable attachment means 34. FIG. 4 shows the strips 36 lining the upper portion of the inside surfaces of the front panel 12, back panel 14 and side panels 16. In operation as previously described, as the front panel 12 is pulled forward towards the back panel 14, the side panels 16A and 16B fold upon each other so that the strip 36 attached to the side panel 16A releasably secures to the strip 36 attached to the inside front panel 12. The strips 36 of the side panels 16B engage the strip 36 attached to the inner surface of the back panel 14. When the backpack 2 is in the closed position as shown in FIG. 1, the panels 12, 14 and 16 are releasably secured to each other as described above by the releasable attachment means 34. This provides an added measure of security when the backpack 2 is worn by the user.

In another embodiment of the invention, the strap guide means 26 is comprised, not of upstanding loops 28 and 30 but of back panel openings 52 and double side panel openings 54 as hereinafter described. In addition, the front strap securing device 22 is secured to the inside surface of the front panel 12 so that the strap may be aligned with the openings 52, 54 as described hereinafter.

Referring specifically to FIGS. 5–8, the strap guide means 26 includes back panel openings 52 and double side panel openings 54. The openings 52 in the back panel appear in the relatively same position as the upstanding loops 28 shown in FIG. 4. The openings, however, are within the back panel 14 and enable the strap arms 18 to extend from the back strap securing device 20 to the front strap securing device 22.

Figure 5:
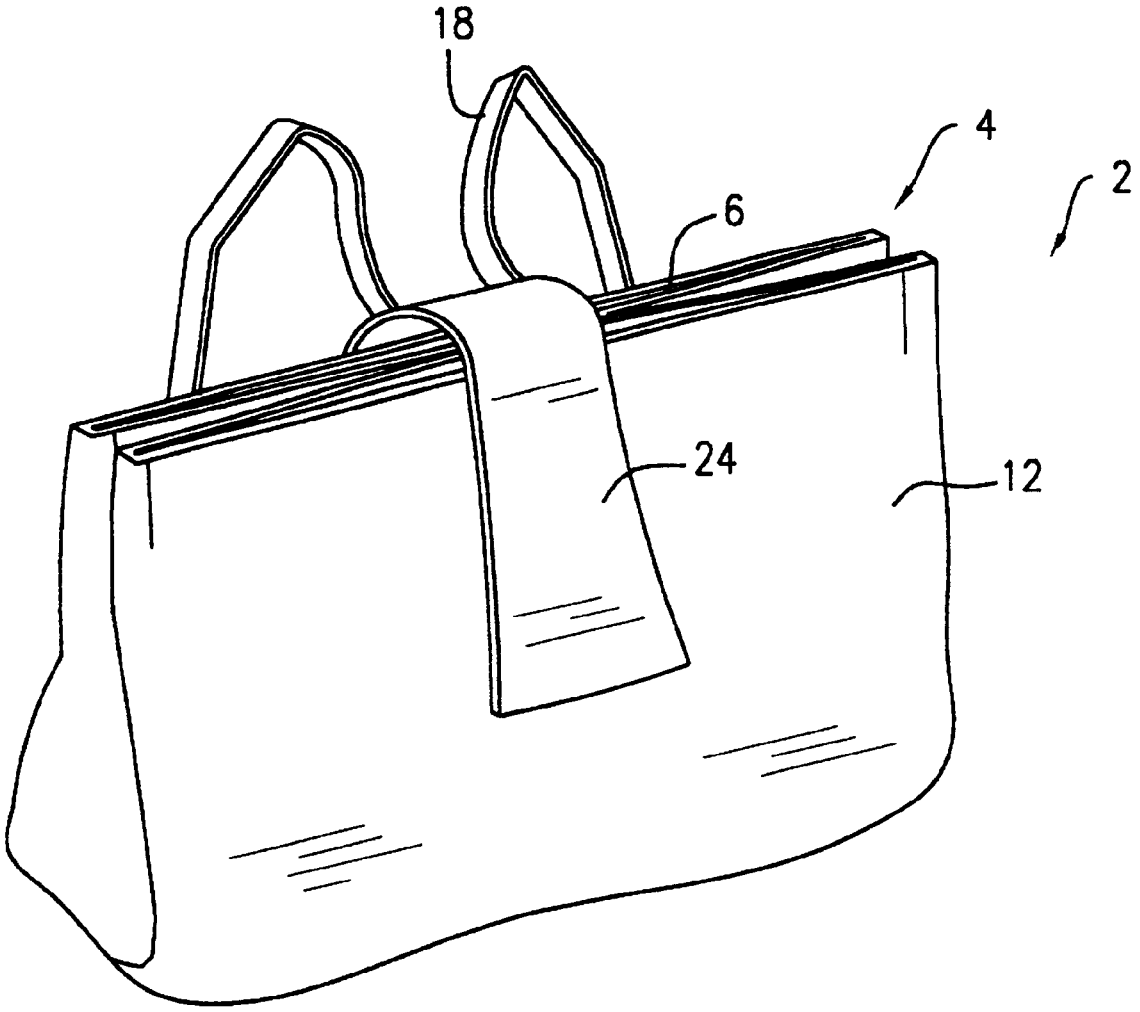
FIG. 5 is a perspective front view of another embodiment of the backpack of the present invention.
Figure 6:
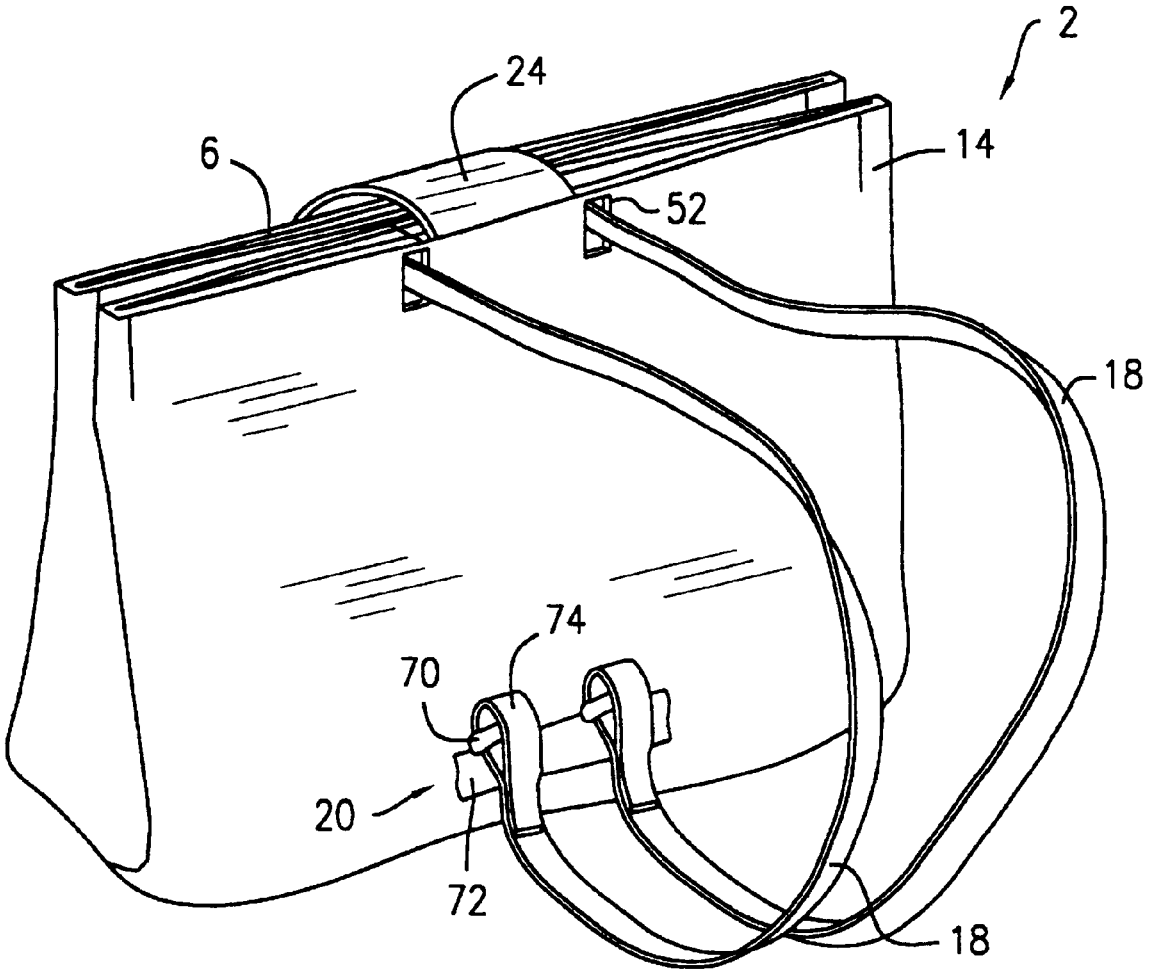
FIG. 6 is a rear view of the embodiment shown in FIG. 5.
Figure 7:
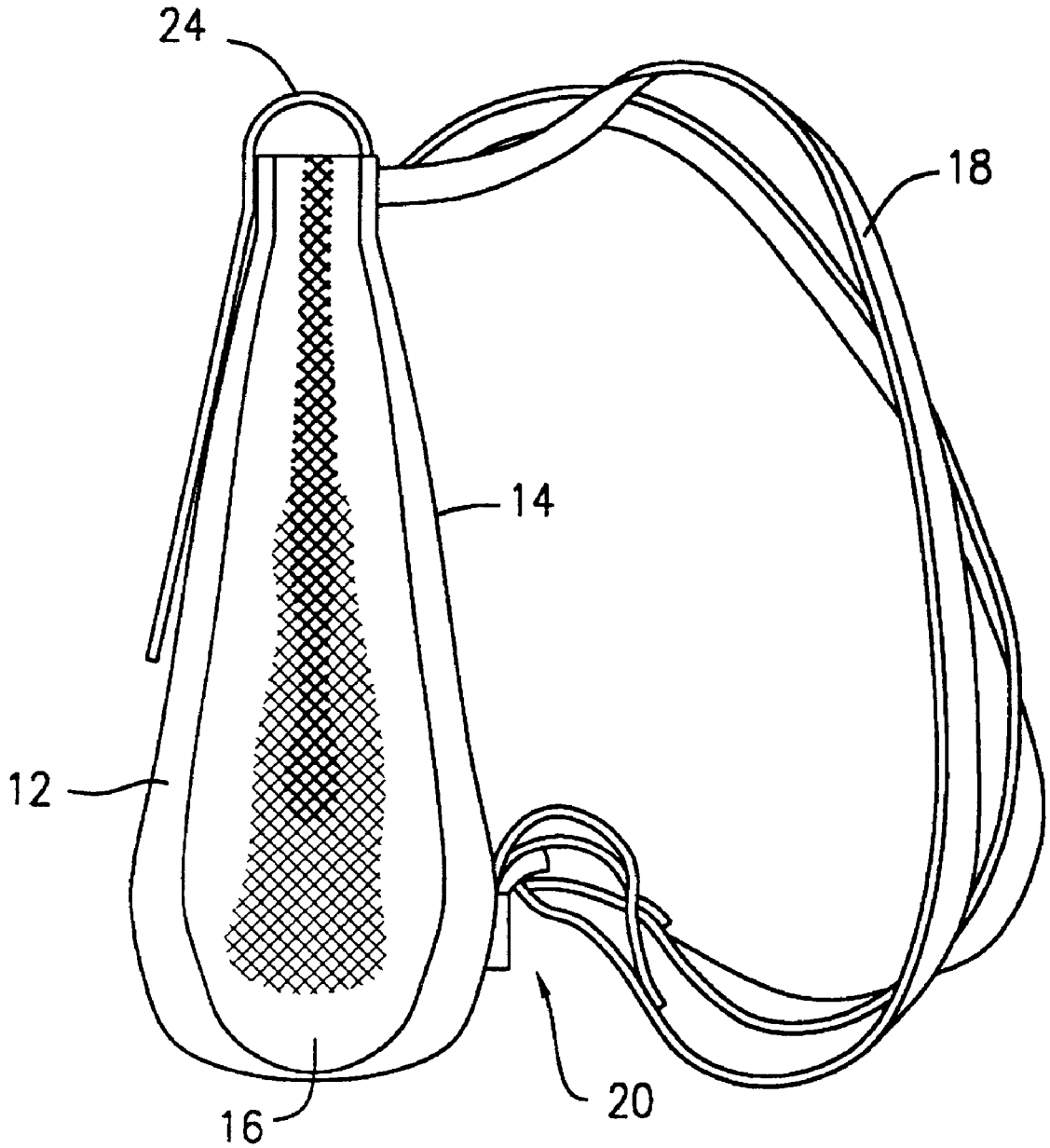
FIG. 7 is a side view of the embodiment shown in FIG. 5.
Figure 8:
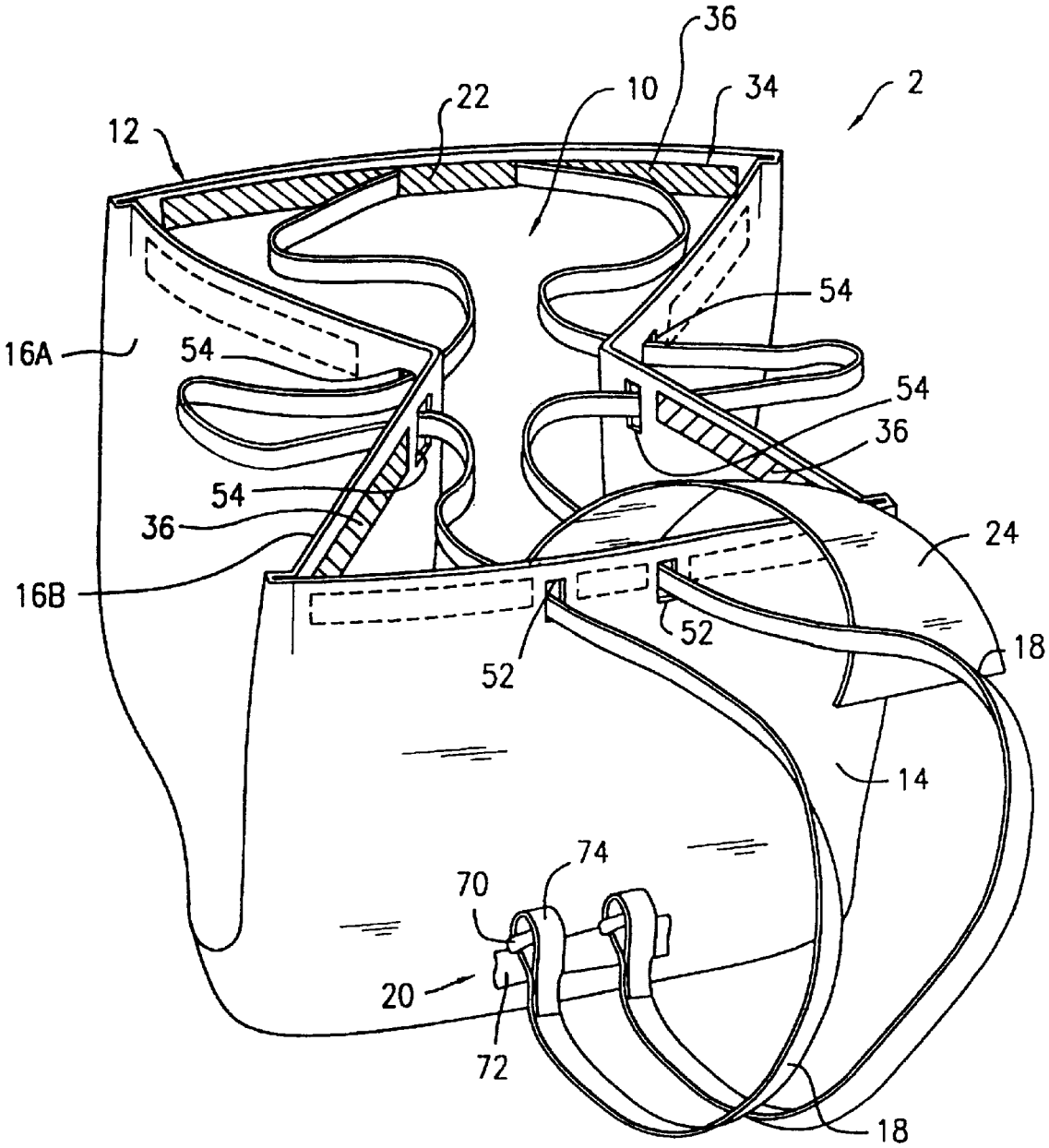
FIG. 8 is a perspective view of the embodiment shown in FIG. 5 with the backpack in a position for receiving or removing articles in the central storage compartment.

Each of the side panels 16A and 16B are provided with openings 54 near the fold line separating the panels 16A and 16B from each other. The operation of the embodiment of FIGS. 5–8 is essentially the same as that of the embodiment of FIGS. 1–4. As the user puts the strap arms 18 around the shoulder, the strap arms 18 together apply a force on the front strap securing device 22 pulling the front panel 12 towards the back panel 14. The position of the double openings 54 in the side panels 16 causes the side panels 16A and 16B to fold one upon the other until the backpack 2 assumes the closed position as shown in FIG. 5.

As previously described in connection with the embodiments of FIGS. 1–4, the backpack 2 shown in FIGS. 5–8 may be provided with a flap 24 and a releasable attachment means 34 which may be comprised of releasably securable strips 36 (e.g. hook and eye strips sold under the trademark Velcro) to provide a further means of securing the backpack 2 in the closed position.

The embodiments shown in FIGS. 1–8 are illustrative of the structure and operation of the present invention. It will be understood that modifications to the present invention can be made within the spirit and the scope of the invention as covered by the claims presented herein.

What is claimed is:

1. A backpack comprising:

(a) a central storage compartment comprising a front panel, a back panel and opposed side panels each defined by a plurality of adjacent panels foldable upon each other, said panels defining an upper opening for entry into the central storage section;

(b) a strap secured to the backpack for releasably enabling the side panels to move from a folded condition thereby closing the upper opening to an unfolded condition whereby the upper opening allows access to the central storage compartment;

(c) strap guide means comprising an upstanding loop extending above a top edge of each of the side panels and a strap securing means, said strap securing means comprising an upstanding strap support extending above the top edge of the front panel and positioned to maintain the strap in a position above the top edge of the front panel; and (d) strap attachment means for securing the strap to the back panel at a position to enable the strap to be placed about the shoulders; wherein the upstanding loops are respectively positioned over the joinder of two adjacent side panels.

2. The backpack of claim 1 further comprising a flap secured to the inside surface of the back panel and releasably secured to the outer surface of the front panel.

3. The backpack of claim 1 further comprising releasable attachment means comprising at least one pair of releasably securable strips which releasably attach to each other when the side panels of the backpack are folded upon each other.

4. The backpack of claim 3 wherein the front panel and back panels also include strips in which the strip of the front panel is securable to the strips of at least one pair of side panels and the strips of the back panel are securable to at least one pair of strips of the side panels.

5. A backpack comprising:

(a) a central storage compartment comprising a front panel, a back panel and plurality of opposed side panels foldable upon each other, said panels defining an upper opening for entry into the central storage section;

(b) a strap secured to the backpack for releasably enabling the side panels to move from a folded condition thereby closing the upper opening to an unfolded condition whereby the upper opening allows access to the central storage compartment;

(c) strap guide means comprising a plurality of openings extending through the side panels, at least one pair of said openings being positioned near the joinder of the two adjacent side panels and a strap securing means positioned on the inside surface of the front panel to secure the strap to the inside surface of the front panel; and (d) strap attachment means for securing the strap to the back panel at a position to enable the strap to be placed about the shoulders.

6. The backpack of claim 5 wherein the strap securing means comprises an elongated sleeve.

7. The backpack of claim 5 further comprising a flap secured to the inside surface of the back panel and releasably secured to the outer surface of the front panel.

8. The backpack of claim 5 further comprising releasable attachment means comprising at least one pair of releasably securable strips which releasably attach to each other when the side panels of the backpack are folded upon each other.

9. The backpack of claim 8 wherein the front panel and back panels also include strips in which the strip of the front panel is securable to the strips of at least one pair of side panels and the strips of the back panel are securable to at least one pair of strips of the side panels.

* * * * *